US006928982B1

(12) United States Patent
Albertson et al.

(10) Patent No.: US 6,928,982 B1
(45) Date of Patent: Aug. 16, 2005

(54) CONTROLLING ENGINE CHARGE DILUTION FOR FUEL EFFICIENCY

(75) Inventors: William C. Albertson, Clinton Township, MI (US); Gary J. Patterson, Utica, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/766,156

(22) Filed: Jan. 28, 2004

(51) Int. Cl.[7] ..... F02M 25/07; F02D 11/10
(52) U.S. Cl. ..... 123/399; 123/568.21; 123/198 F
(58) Field of Search ..... 123/361, 396, 123/399, 400, 311, 90.15, 90.16, 90.17, 90.18, 123/568.14, 395, 316, 481, 198 F, 347, 348, 123/568.21

(56) References Cited

U.S. PATENT DOCUMENTS 5,372,108 A * 12/1994 Wu ..... 123/90.15
5,666,931 A * 9/1997 Pierik et al. ..... 123/568.21
5,749,343 A * 5/1998 Nichols et al. ..... 123/396
6,390,063 B1 * 5/2002 Obata et al. ..... 123/399
6,814,035 B2 * 11/2004 Eiraku ..... 123/395

* cited by examiner

*Primary Examiner*—Willis R. Wolfe, Jr.
(74) *Attorney, Agent, or Firm*—Christopher DeVries

(57) ABSTRACT

Fuel consumption in a vehicle engine is reduced by varying charge dilution in an intake manifold of the engine to maintain a pressure in the intake manifold within a predetermined range. Pumping work performed by engine cylinders is reduced, which reduces fuel consumption.

17 Claims, 3 Drawing Sheets

CONTROLLING ENGINE CHARGE DILUTION FOR FUEL EFFICIENCY

FIELD OF THE INVENTION

The present invention relates generally to vehicle engine control systems, and more particularly to controlling fuel consumption in a vehicle engine.

BACKGROUND OF THE INVENTION

In a variable displacement engine, fuel efficiency tends to increase when fewer than all cylinders are activated. Pumping work that would have been performed by a deactivated cylinder on an intake stroke of a four-stroke cycle is temporarily reduced significantly, thereby reducing fuel consumption and improving fuel efficiency at low engine loads and/or speeds. When operating conditions are such that higher engine torque is called for, all cylinders may become activated to supply the demand.

In a vehicle in which cylinder deactivation is implemented, typically half the total number of engine cylinders, e.g., every other cylinder in a vehicle firing order, are deactivated. There are limits, however, to deactivating cylinders to improve fuel efficiency. For example, vehicle noise and vibration tend to increase when more than half the total number of engine cylinders are deactivated.

SUMMARY OF THE INVENTION

The present invention, in one embodiment, is directed to a method for controlling fuel consumption in a vehicle engine. The method includes varying charge dilution in an intake manifold of the engine to maintain a pressure in the intake manifold within a predetermined range.

In another embodiment, the present invention is directed to a method for controlling fuel consumption in a variable displacement engine wherein at least one cylinder is deactivated. The method includes varying charge dilution in an intake manifold of the vehicle to reduce pumping work by at least one activated cylinder.

In yet another embodiment, the invention is directed to a vehicle engine control system. The control system includes an intake manifold through which fuel and air are delivered to at least one cylinder of the engine, and a controller that varies charge dilution in said intake manifold to maintain a pressure in said intake manifold within a predetermined range.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF EXEMPLARY EMBODIMENTS

The following description of various embodiments of the present invention is merely exemplary in nature and is in no way intended to limit the invention, its application, or uses. Although embodiments of the present invention are described with reference to a variable displacement engine, the invention is not so limited. Embodiments of the present invention can be practiced in connection with a wide variety of engines, including engines which do not have variable displacement.

Figure 1:
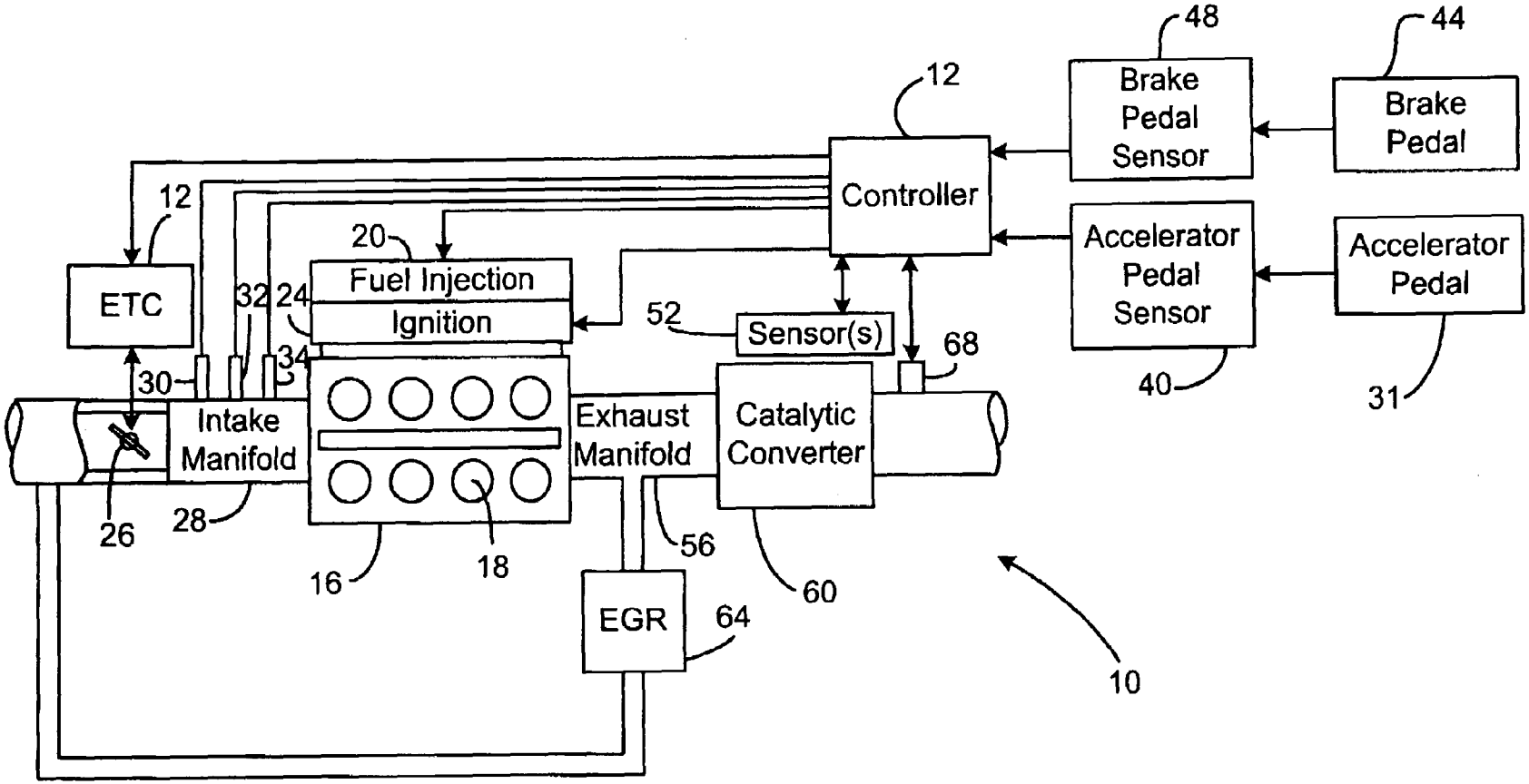
FIG. 1 is a diagram of an engine control system according to one embodiment of the present invention.

Referring now to FIG. 1, an engine control system 10 according to one embodiment of the present invention includes a controller 12 and an engine 16. The engine 16 is, for example, a variable displacement engine that includes a plurality of cylinders 18, a fuel injection system 20 and an ignition system 24. An electronic throttle controller (ETC) 12 adjusts a throttle 26 in an intake manifold 28 based upon a position of an accelerator pedal 31 and a throttle control algorithm that is executed by the controller 12. A manifold pressure sensor 30 and manifold temperature sensor 32 sense pressure and temperature in the intake manifold 28. A mass air flow sensor (MAFS) 34 senses air flowing to the engine 16.

A position of the accelerator pedal 31 is sensed by an accelerator pedal sensor 40, which generates a pedal position signal that is output to the controller 12. A position of a brake pedal 44 is sensed by a brake pedal sensor 48, which generates a brake pedal position signal that is output to the controller 12. Sensors 52 such as a temperature sensor, a barometric pressure sensor, and other conventional sensor and/or controller signals are used by the controller 12 to control the engine 16. Power output by the engine 16 is transmitted by a torque converter and transmission (not shown) to front and/or rear wheels.

Exhaust output by the engine 16 passes through an exhaust manifold 56 and a catalytic converter 60. Exhaust may also pass through an exhaust gas recirculation (EGR) valve 64 to the intake manifold 28 as further described below. One or more emissions system sensors 68 are used by the controller 12 to control the engine 16.

Figure 2:
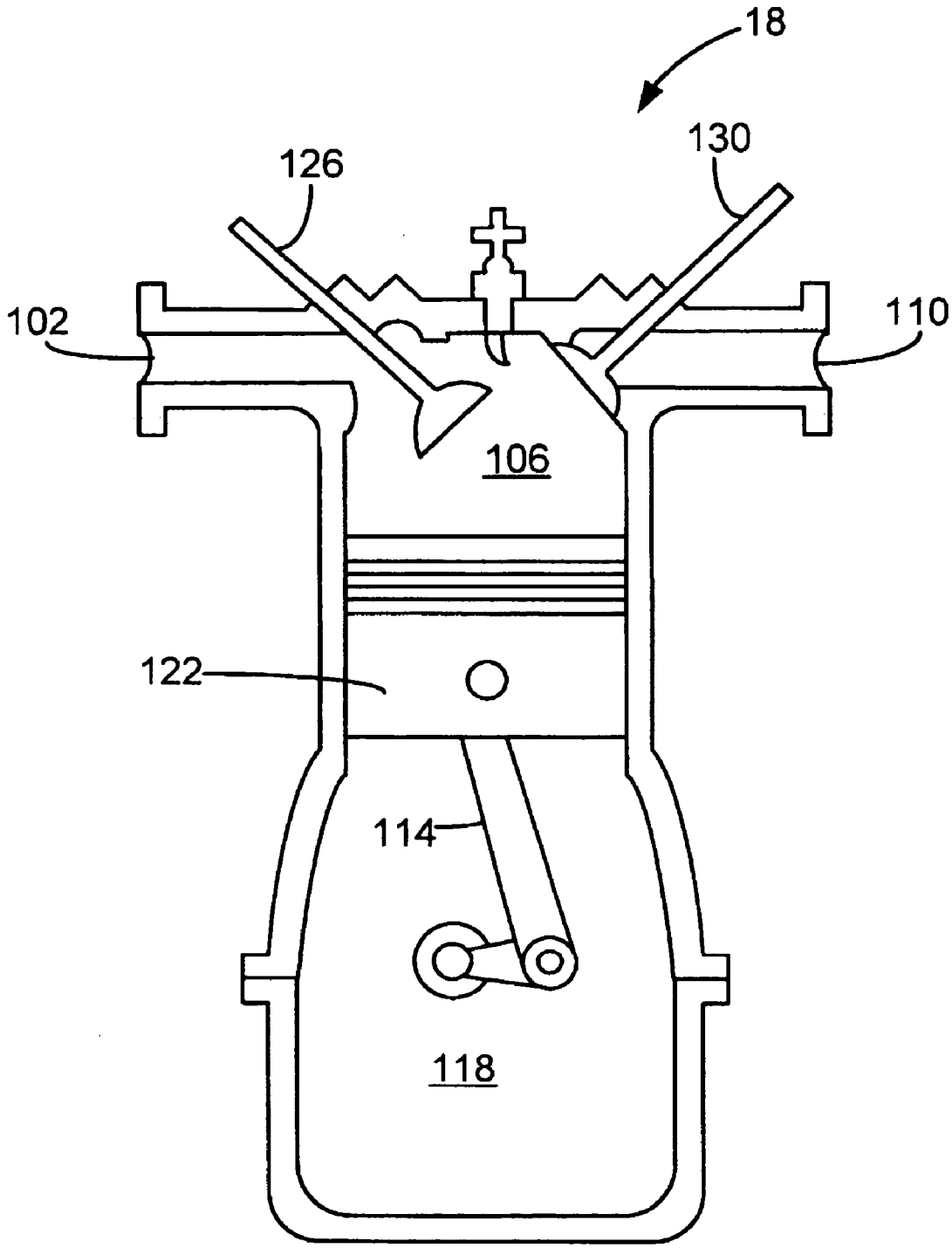
FIG. 2 is a diagram of an embodiment of a engine cylinder.

A cylinder 18 is shown in greater detail in FIG. 2. An inlet 102 fluidly connects the intake manifold 28 (shown in FIG. 1) with a combustion chamber 106. An exhaust outlet 110 is connected to the exhaust manifold 56 (shown in FIG. 1). A crankshaft 114 mounted in a crankcase 118 as known in the art is operable to cause a piston 122 to reciprocate relative to the combustion chamber 106. An intake valve 126 is operable to open and/or close the inlet 102, and an exhaust valve 130 is operable to open and/or close the exhaust outlet 110.

When the throttle 26 (shown in FIG. 1) is partially open during an intake stroke of the piston 122, pressure in the inlet 102 is below atmospheric pressure. Pressure in the crankcase 118, however, tends always to be at nearly atmospheric pressure. Thus the relatively lower pressure atop the piston 122 works against the crankshaft 114 during the intake stroke. Operating the engine on fewer than all cylinders 18, for example, at relatively light engine loads, results in a higher pressure in the intake manifold 28 than would be observable when all cylinders 18 are activated. Intake manifold pressure increases because no air flows into or out of a deactivated cylinder 18. The relatively higher intake manifold pressure reduces pumping work on the intake stroke of an activated cylinder 18 and thereby increases fuel efficiency.

While intake manifold pressure tends to increase during periods of cylinder deactivation in a variable displacement engine, relatively high pumping losses still can occur, particularly at relatively light loads. Increasing charge dilution in an intake manifold can increase manifold pressure. Generally, by increasing intake manifold pressure in accordance with an embodiment of the present invention, pumping work by the cylinders 18 can be reduced under various operating conditions. In one embodiment, for example, intake manifold pressure is increased, and pumping work is reduced by increasing charge dilution at light engine loads. A "light" load refers, for example, to vehicle operation at an engine speed that causes intake manifold pressure to range between about 20 kPa and about 82 kPa prior to increasing charge dilution according to one embodiment. Embodiments also are contemplated for implementation in vehicles having a negative intake manifold pressure, e.g., a vacuum of between about 5 and 7 kPa.

Figure 3:
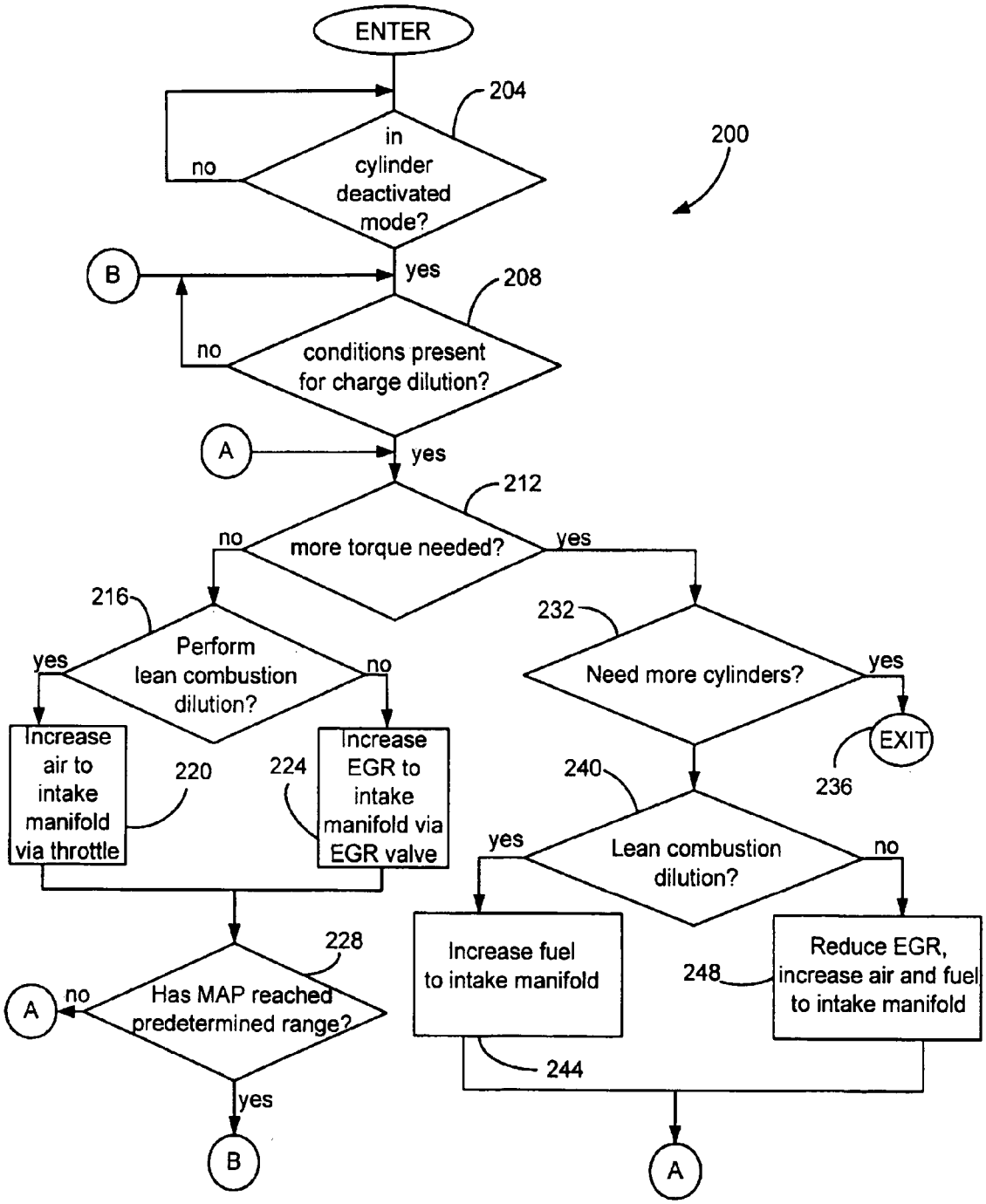
FIG. 3 is a flow diagram of a method for controlling fuel consumption in a variable displacement engine according to one embodiment of the present invention.

In one embodiment, engine charge dilution is increased through lean burning when intake manifold pressure would otherwise be low. In another embodiment, charge dilution is increased through exhaust gas re-circulation (EGR) when intake manifold pressure would otherwise be low. An exemplary method for controlling fuel consumption in a variable displacement engine is indicated generally in FIG. 3 by reference number 200. The method 200 may be performed, for example, by the controller 12 (shown in FIG. 1) and shall be described with reference to FIG. 1.

In step 204, it is determined whether the engine 16 is operating in a cylinder deactivated mode. If yes, in step 208, it is determined whether one or more conditions are present for performance of charge dilution as further described below. Such conditions can include, for example, whether pressure in the intake manifold 28 is lower than a threshold value, e.g., 80 kPa. If conditions(s) are met in step 208, it is determined, in step 212, whether additional torque is called for. If not, in step 216, it is determined whether lean burning is to be performed. If yes, in step 220, air is increased to the intake manifold 28 via the throttle 26. If it determined in step 216 that lean burning is not to be performed, then in step 224, EGR is increased to the manifold 28 via EGR valve 64. In step 228, it is determined whether pressure at the intake manifold 28 has reached a predetermined range, e.g., between 80 and 97 kPa at sea level conditions. If not, control returns to step 212. Thus the controller 12 increases the amount of air delivered to the engine 16 without increasing an amount of fuel delivered, or increases EGR delivered to the engine 16, until the intake manifold pressure is within the predetermined pressure range. If in step 228 the manifold pressure has reached the predetermined pressure range, control is returned to step 208.

If in step 212 it is determined that more torque is demanded, then, in step 232, it is determined whether additional cylinders 18 are to be activated. If yes, control exits the present method in step 236, and a cylinder activation procedure (not shown) is performed. If no additional cylinders 18 are to be activated, then, in step 240, it is determined whether lean burning or EGR dilution is implemented in the engine 16. If lean burning is implemented, then, in step 244, fuel is increased to the intake manifold 28 and control is returned to step 212. If EGR dilution is implemented, then, in step 248, EGR to the manifold 28 is reduced, air and fuel to the manifold 28 are increased, and control then is returned to step 212.

Generally, when an engine is operated in a cylinder-deactivated mode, in-cylinder pressures are higher than when all cylinders are activated. In such case, relatively higher levels of charge dilution, and relatively higher levels of EGR dilution or lean combustion dilution, can be tolerated. In the case of EGR dilution, under operating conditions when intake manifold pressure would normally be relatively low, exhaust gas can be added to raise intake manifold pressure. As a driver requests more torque through movement of the accelerator pedal 31, exhaust gas to the manifold 28 can be reduced and air and fuel delivery can be increased accordingly. In the case of lean combustion dilution, under operating conditions when intake manifold pressure would normally be relatively low, increased air flow can be added through opening of the throttle 26 to raise intake manifold pressure. This results in a diluted lean combustion. As the driver requests more torque through movement of the accelerator pedal 31, fuel delivery to the manifold 28 can be increased accordingly. In a vehicle in which lean combustion dilution is implemented, it is recommended that a lean catalyst be used.

Embodiments of the foregoing methods and systems can reduce pumping work in an engine, thereby reducing fuel consumption. Where an engine operates in cylinder deactivated mode, fuel savings due to cylinder deactivation are further increased when charge dilution is implemented as described above. Charge dilution results in higher intake manifold pressures and generally can be adjusted to a fine degree of granulation.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A method for controlling fuel consumption in a vehicle engine, comprising:

varying charge dilution in an intake manifold of the engine;

maintaining a pressure in the intake manifold within a predetermined range using said varying step;

predetermining said range to reduce pumping work by at least one engine cylinder.

2. The method of claim 1 wherein said varying charge dilution step comprises increasing charge dilution until said intake manifold pressure reaches said predetermined range.

3. The method of claim 1 wherein said varying charge dilution step comprises varying air delivery to the intake manifold.

4. The method of claim 3 wherein said varying air delivery step comprises one of opening and closing a throttle of the vehicle.

5. The method of claim 1 further comprising increasing fuel to the intake manifold in accordance with a request for additional torque.

6. The method of claim 1 wherein said varying charge dilution step comprises varying exhaust gas to the intake manifold.

7. The method of claim 6 further comprising decreasing said exhaust gas and increasing air and fuel to the manifold in accordance with a request for additional torque.

8. A method for controlling fuel consumption in a variable displacement engine, comprising:

deactivating at least one cylinder; and varying charge dilution in an intake manifold of the vehicle to reduce pumping work by at least one activated cylinder.

9. The method of claim 8 wherein said varying charge dilution step comprises increasing charge dilution until a predetermined intake manifold pressure is reached.

10. The method of claim 8 wherein said varying charge dilution step comprises varying air delivery to the intake manifold.

11. The method of claim 10 wherein said varying air delivery step comprises opening or closing a throttle of the vehicle.

12. The method of claim 8 further comprising increasing fuel to the intake manifold in accordance with a request for additional torque.

13. The method of claim 8 wherein said varying charge dilution step comprises varying exhaust gas to the intake manifold.

14. The method of claim 13 further comprising decreasing said exhaust gas and increasing air and fuel to the manifold in accordance with a request for additional torque.

15. A vehicle engine control system comprising:

an intake manifold through which fuel and air are delivered to at least one cylinder of the engine; and a controller that varies charge dilution in said intake manifold to maintain a pressure in said intake manifold within a range predetermined to reduce pumping work by at least one said cylinder.

16. The control system of claim 15 further comprising an exhaust manifold that receives exhaust gas from the engine, wherein said controller varies charge dilution in said intake manifold by varying exhaust gas to said intake manifold.

17. The control system of claim 15 further comprising a throttle that controls air delivery to said intake manifold, wherein said controller one of opens and closes said throttle to vary said charge dilution.

* * * * *